United States Patent [19]

Wallace, Jr.

[11] 4,421,957

[45] Dec. 20, 1983

[54] END-FIRE MICROPHONE AND LOUDSPEAKER STRUCTURES

[75] Inventor: Robert L. Wallace, Jr., Warren, N.J.

[73] Assignee: Bell Telephone Laboratories, Incorporated, Murray Hill, N.J.

[21] Appl. No.: 273,734

[22] Filed: Jun. 15, 1981

[51] Int. Cl.[3] ..... H01R 1/10

[52] U.S. Cl. ..... 179/121 D; 179/146 E; 181/184; 181/182

[58] Field of Search ..... 181/146, 145, 160, 182, 181/152, 159, 155, 184; 179/1 CP, 1 DM, 1 E, 121 D

[56] References Cited

U.S. PATENT DOCUMENTS

| | | | |
|---|---|---|---|
| 1,475,769 | 11/1923 | Meyer | 181/145 |
| 1,795,874 | 3/1931 | Mason | 181/146 |
| 1,825,166 | 9/1931 | Sullivan | 181/146 |
| 1,847,283 | 3/1932 | Volf, Jr. | 181/146 |
| 1,847,284 | 3/1932 | Volf, Jr. | 181/146 |
| 1,876,466 | 9/1932 | Moore, Jr. | 181/146 |
| 3,739,096 | 6/1973 | Iding | 179/1 E |

*Primary Examiner*—G. Z. Rubinson
*Assistant Examiner*—Robert Lev
*Attorney, Agent, or Firm*—Robert O. Nimtz; Jack S. Cubert

[57] ABSTRACT

Highly directional response patterns can be obtained by connecting microphones or loudspeakers with tubular coupling path structures. The coupling paths comprise a plurality of elements (110,111 . . . 157) arranged in pairs (110,111; 112,113; . . . 156,157) so that for every element (110) below a center line (102) there is an element (111) above the line. Furthermore, the relationship between the element pairs is nonlinear. The desired directional response comprises one main lobe and a plurality of substantially smaller lobes below a determinable threshold value. The elements may be a bundle of tubes (90) or a plurality of apertures (110,111, . . . 157) in a single tube (100).

9 Claims, 15 Drawing Figures

END-FIRE MICROPHONE AND LOUDSPEAKER STRUCTURES

BACKGROUND OF THE INVENTION

1. Field of the Invention

This invention relates to acoustic arrays and, in particular, to endfire microphone or loudspeaker arrays.

2. Description of the Prior Art

It has been desirable to secure improved response for a wide range of frequencies, such as is encountered in the transmission of speech or music. One apparatus used for achieving this objective was through the use of an impedance device comprising a plurality of substantially equal diameter tubes having uniformly varying lengths arranged in a bundle. Another apparatus used a single tube with apertures spaced equally apart having substantially the same dimensions. Typically, such impedance devices are coupled to a microphone or a loudspeaker and are known as endfire acoustic arrays.

In each of the devices described above, the response pattern comprises one main lobe and a plurality of gradually decreasing smaller sidelobes. These sidelobes represent undesired response to signals coming from other than a desired direction.

SUMMARY OF THE INVENTION

In accordance with the illustrative embodiment of the present invention, energy emitted from a source is propagated to a transducer through a plurality of coupling paths, the relationship between the coupling paths being nonlinear and the response pattern from the coupling paths comprising one main lobe and a plurality of sidelobes equal to or less than a desired threshold value.

In one embodiment, the coupling paths comprise a tube having a plurality of substantially identical collinear apertures. The apertures are arranged in pairs such that the conjugates are equidistant from, and located on opposite sides of, a center line drawn perpendicular to the length of the tube. The relationship of the distances between the pairs of apertures is nonlinear and is determined according to the method of steepest descent. The distances between the apertures is such that the response pattern comprises one main lobe and a plurality of sidelobes substantially equal to or less than the desired threshold value.

In another embodiment, the coupling paths comprise a plurality of tubes having substantially identical diameters and arranged in a bundle so that one end of each tube is coupled with a common transducer. Furthermore, the tubes vary in length so that for every tube whose free end falls short of a center line, drawn perpendicular to the length of the arrangement, there is a tube which falls beyond the center line by an equal distance thereby defining a symmetric array. Additionally, the relationship among the lengths of the tubes is determined by the aforesaid method of steepest descent such that the response of the arrangement comprises one main lobe and a plurality of sidelobes substantially equal to or less than a desired threshold value.

DETAILED DESCRIPTION

Figure 1:
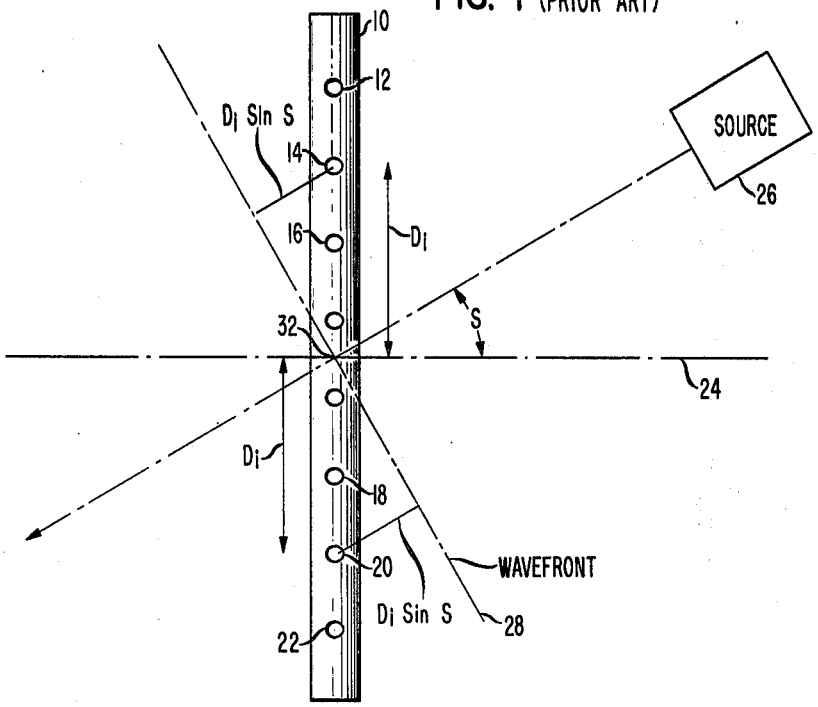
FIG. 1 (PRIOR ART)
FIG. 1 shows a broadside acoustic array.

Referring to FIG. 1, there is shown a broadside array 10 comprising a plurality of pairs of microphone or loudspeaker elements 12,22; 14,20; 16,18; . . . the elements of each pair being equidistant from a center line 24.

The length of the array is defined as the distance between the pair of elements farthest from center line 24. Thus, if the length of the array is chosen to be 8 wavelengths and if the performance is to be optimum at, say, 3521 Hz, using the principles of physics, the length of the array can be found to be $$(1128/3521)\times 12\times 8=30.75 \text{ inches}$$

where 1128 is the velocity of sound in air in feet per second at 70 degrees Fahrenheit.

If a source 26 is sufficiently far away from the array 10, sound emitted from source 26 can be considered to impinge on array 10 in a plane 28. Thus, plane 28 will reach element 14 before reaching the conjugate element 20 of the pair 14,20, each element being at a distance $D_i$ wavelengths from the center line 24. If plane 28 makes an angle 90-S with center line 24, the plane will reach element 14 by the time required to travel a distance $D_i$Sin S wavelengths before reaching center point 32 of the array 10. Likewise, the plane 28 will reach element 20 by the time required to travel $D_i$Sin S after reaching the center point 32 of the array 10.

As is well known in the art, the output of each element may be expressed by the plane wave equation in complex form as $Ae^{-j(\omega t-kx)}$ where kx is the delay factor and A is the sensitivity of the element.

If the output signals from the elements are to be in phase, the output from element 14 must be delayed by a factor of $e^{-j2\pi DiSinS}$ and the output from element 20 must be advanced by a factor of $e^{j2\pi DiSinS}$. Likewise, the output from all the other elements must also be adjusted. Because the elements may be microphones or loudspeakers, electrical delays can be used. Furthermore, because it is not possible to obtain negative delays for elements below center line 24, it is necessary to introduce delays to all elements with respect to element 22. It is possible, then, to build an array for optimum performance when a sound plane is incident at an angle S to the center line 24 of the array 10 with built-in delays, i.e., to steer the main lobe of the response to the angle S.

When sound is incident on such an array at a different angle $\theta$, the response from the upper elements will be affected by a factor of $e^{-j2\pi D_i Sin\theta}$. Likewise, the response from the lower elements will be affected by a factor of $e^{j2\pi D_i Sin\theta}$. That is, the response will be affected by:

$$\text{(a) from the upper elements } e^{+j2\pi D_i(Sin\theta - SinS)} \quad (1)$$

and $$\text{(b) from the lower elements } e^{-j2\pi D_i(Sin\theta - SinS)} \quad (2).$$

Since $e^{j\phi} = \text{Cos}\,\phi + j\text{Sin}\phi$, expressions (1) and (2) can be combined to obtain a factor by which the response of a pair of elements must be adjusted, i.e., $$2\,\text{Cos}\,[2\pi D_i(\text{Sin}\theta - \text{SinS})] \quad (3).$$

The response of the pair of elements is $$R_i = 2A_i\,\text{Cos}[2\pi D_i(\text{Sin}\theta - \text{SinS})] \quad (3a)$$

If there are N pairs of elements, i.e., 2N elements, the normalized response of array 10 will be $$R = \frac{2\sum_{i-1}^{N} \text{Cos}[2\pi D_i(\text{Sin}\theta - \text{Sin}S)]}{2N}. \quad (4)$$

Because the array 10 is a broadside array, S=0 and equation (4) becomes $$R = \frac{2\sum_{i-1}^{N} \text{Cos}(2\pi D_i \text{Sin}\theta)}{2N}. \quad (5)$$

Figure 2:
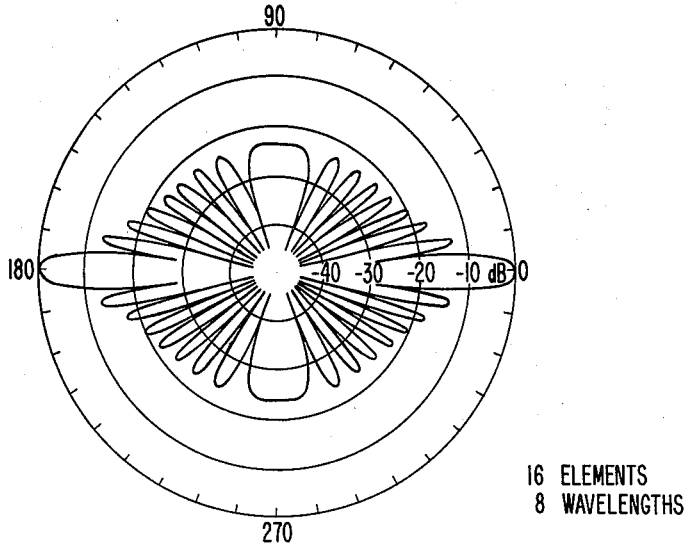
FIG. 2 (PRIOR ART)
FIG. 2 shows a response pattern for the broadside array of FIG. 1 where the elements are uniformly spaced.

The response for a broadside array, with elements spaced equally apart, is shown in FIG. 2.

If the array 10 is steered to 90 degrees, i.e., $S=\pi/2$ radians, equation (4) becomes $$R = \frac{2\sum_{i-1}^{N} \text{Cos}[2\pi D_i(\text{Sin}\theta - 1)]}{2N}. \quad (6)$$

Figure 3:
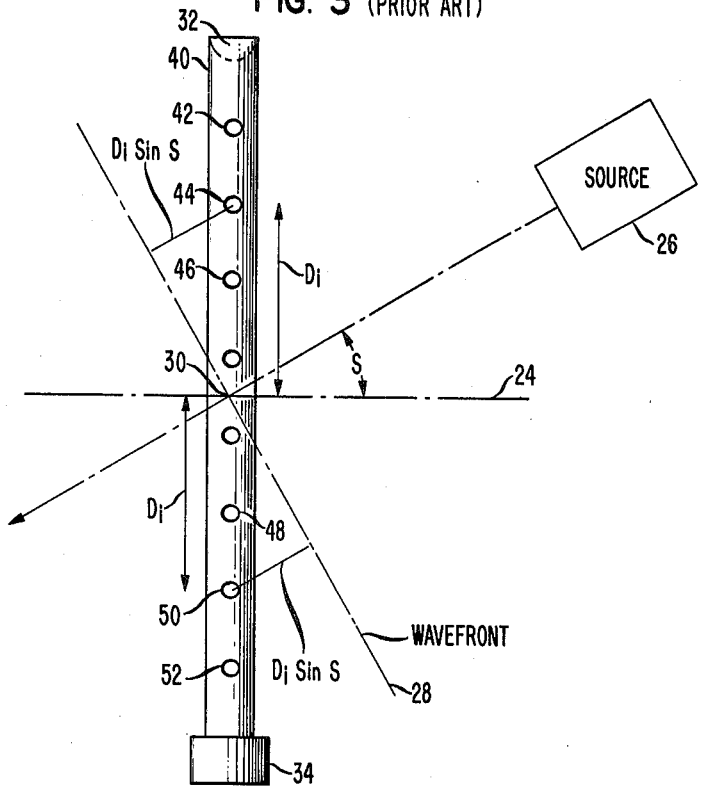
FIG. 3 (PRIOR ART)
FIG. 3 shows an endfire acoustic array.

Instead of using a broadside array steered to 90 degrees, it is possible to achieve the same response by using an endfire acoustic array. Referring to FIG. 3, endfire acoustic array 40 comprises substantially identical sized aperture pairs 42,52; 44,50; 46,48...perforated in a tube of uniform diameter, the elements of each pair being equidistant from and on opposite sides of a center line 24 and the distance between adjacent apertures being identical. One end of the array 40 has an acoustic sound absorbing plug 32 and the other end has a utilization means 34 which may be a microphone or a loudspeaker.

Whereas in the broadside array the elements were microphones or loudspeakers, in the endfire array the elements may be apertures. In the endfire acoustic array 40, the delay corresponding to each aperture is the time taken by sound to travel through tube 40 between that aperture and the utilization means 34. Sound entering through the plurality of apertures will be in phase at the utilization means 34 only when sound is coming from 90 degrees, i.e., from a source parallel to the length of the array. At angles other than 90 degrees, the signals do not arrive in phase at the utilization means 34 resulting in sidelobes of reduced level.

Figure 4:
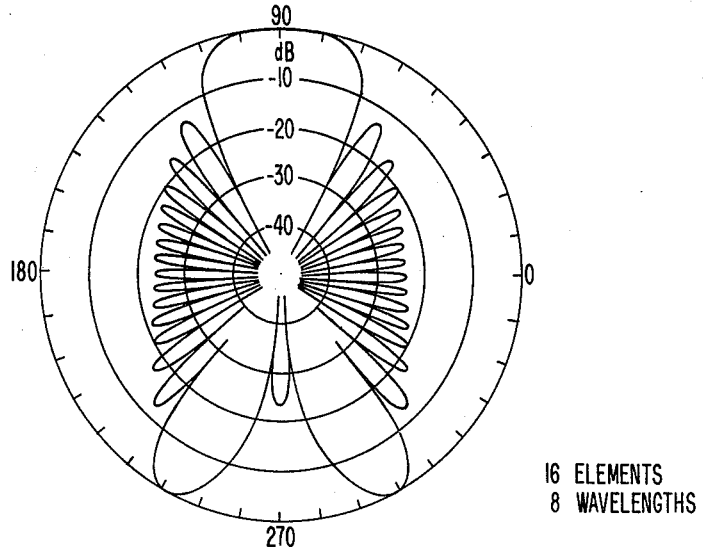
FIG. 4 (PRIOR ART)
FIG. 4 shows a response pattern for the endfire array of FIG. 3 where the elements are uniformly spaced.

The response for an endfire array where the elements are uniformly spaced is shown in FIG. 4. The main lobe is steered to 90 degrees or $\pi/2$ radians. Near $3\pi/2$ radians or 270 degrees, there appear two large undesirable sidelobes. It has been found that in increasing the design frequency by a factor of two, the two large sidelobes can be eliminated. That is, if the design frequency is 3521 Hz, by designing the array for operation at 7042 Hz, the two large sidelobes are eliminated. That is to say, by multiplying $D_i$ by a factor of two in equation (6) the two large sidelobes can be eliminated. Thus equation (6), for endfire arrays, becomes $$R = \frac{2\sum_{i=1}^{N} \text{Cos}[4\pi D_i(\text{Sin}\theta - 1)]}{2N}. \quad (7)$$

Figure 6:
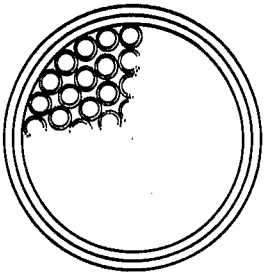
FIG. 6 (PRIOR ART)
FIG. 6 shows a cross-section of the tubes in FIG. 5 through the plane 6—6.
Figure 5:
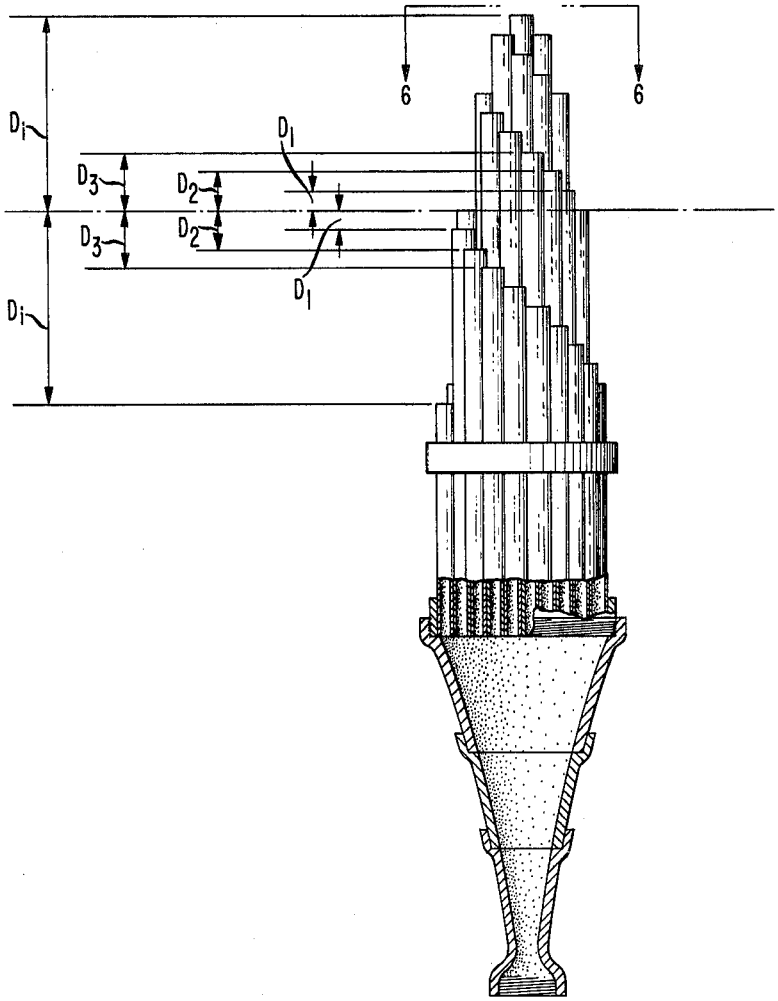
FIG. 5 (PRIOR ART)
FIG. 5 shows an acoustic impedance device comprising a plurality of tubes having uniformly varying lengths in an endfire array.

Referring to FIG. 5, there is shown an impedance device comprising a plurality of tubes having progressively varying lengths, in uniform increments. Such an arrangement is disclosed in U.S. Pat. No. 1,795,874 granted Mar. 10, 1931 to Mr. W. P. Mason. The Mason impedance device improves response patterns appreciably over then previously known devices. FIG. 6 shows in cross section, through plane 6—6, the impedance device shown in FIG. 5.

Figure 7:
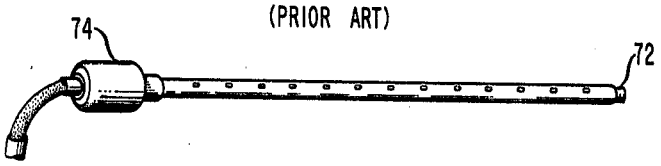
FIG. 7 (PRIOR ART)
FIG. 7 shows an acoustic impedance device comprising a single tube having a plurality of apertures spaced equally apart in an endfire array.

Referring to FIG. 7, there is shown a tube comprising a plurality of uniformly spaced apertures. The tube is closed at one end by an acoustic sound absorbing plug 72 and is coupled at the other end with a transducer 74. Such a device is disclosed at page 224 in "Microphones" by A. E. Robertson, 2d Edition, Hayden, 1963. Indeed, such a device has been manufactured by a German manufacturer, Sennheiser, Model No. MKH-816P48. Such a device is useful in improving response and is useful in the broadcasting and the entertainment fields.

Figure 8:
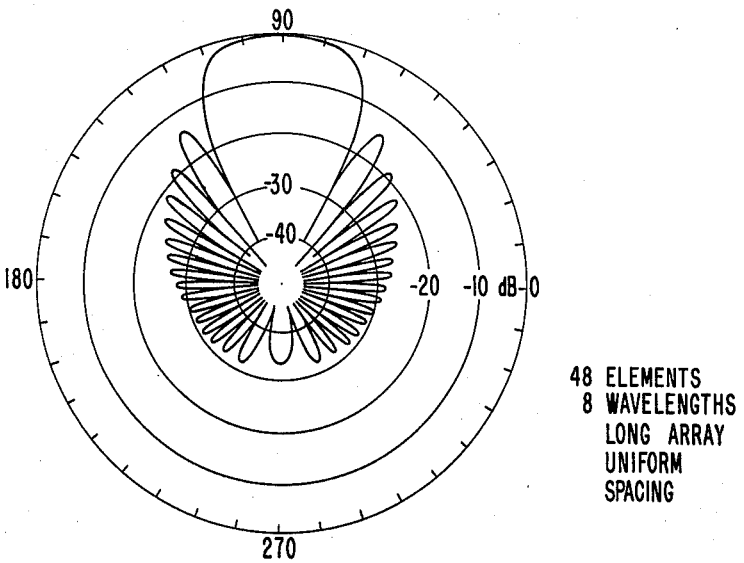
FIG. 8 (PRIOR ART)
FIG. 8 shows a response pattern for the structure in FIG. 7.

As stated earlier in connection with FIG. 4, there appeared two large sidelobes near $\theta = 3\pi/2$ radians. To eliminate the two sidelobes, a factor of two was used in the computations for the spacing in equation 7. Referring to FIG. 8, there is shown the resulting response pattern that is obtainable from endfire arrays, as shown either in FIG. 5 or in FIG. 7, with 48 elements and 8 wavelengths in length. As shown in FIG. 8, when a factor of two was used, the two sidelobes disappear. Although the two large sidelobes have been eliminated, the remaining sidelobes vary in intensity, interfere with fidelity and consequently are undesirable.

The effect from the undesirable sidelobes can be reduced substantially by adjusting the spacing between the apertures in the tube in FIG. 7 or by varying the lengths of the tubes in FIG. 5 according to the method of steepest descent. The method of steepest descent is defined at page 896 of *The International Dictionary of Applied Mathematics*, published by D. Van Nostrand Company, Inc., Princeton, N. J., Copyright 1960.

Figure 9:
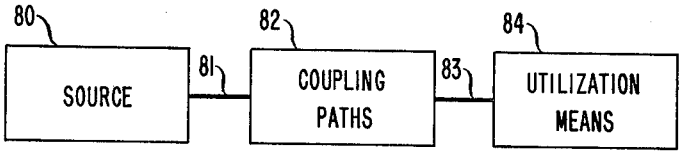
FIG. 9 is a block diagram of an acoustic system.

Referring to FIG. 9, there is shown a transmission system embodying the present invention. A source of sound 80 is connected by line 81 to a coupling path 82. Coupling path 82 is connected by line 83 with a utilization means 84. In one application, source 80 may be a speaker, line 81 the atmosphere, coupling paths 82 some physical means connected directly with utilization means 84 which may be a telephone transmitter connected to a telecommunication system for transmission of voice signals. In another arrangement, source 80 may be sound from a louspeaker connected directly with coupling paths 82, line 83 the atmosphere and utilization means 84 a listener.

Figure 10:
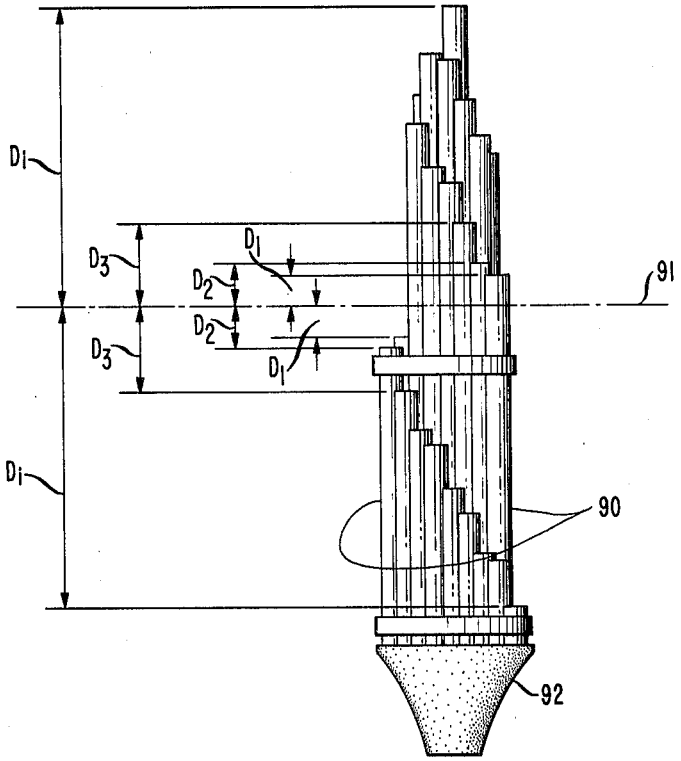
FIG. 10 shows coupling means comprising an endfire array with a plurality of tubes having nonuniformly varying lengths in accordance with the present invention.

Referring to FIG. 10, there is shown an embodiment of the coupling path 82 of FIG. 9. The coupling path comprises a plurality of tubes 90 arranged in pairs so that one tube in each pair is as far below a center line 91 as the other tube in that pair is above the center line 91 and such that the relationship of the differences in lengths between the pairs varies nonlinearly according to the method of steepest descent. The application of the method of steepest descent to the spacing of acoustic elements in an array was disclosed in detail in U.S. patent application, Ser. No. 104,375, now U.S. Pat. No. 4,311,874 filed Dec. 17, 1979, by the same applicant herein and assigned to the same assignee herein.

As described in U.S. Pat. No. 4,311,874, the response for a broadside array of 2N apertures is set forth in equation 6 where the angle $\theta$ is substituted for the angle J of the patent and the term Sin J of the patent is replaced by Sin $\theta$-1 because of the 90° shift in the direction of desired response of the end-fire array. The frequency doubling to eliminate the undesired pair of sidelobes results in equation 7 for the end-fire array. With uniform spacing, the first sidelobe of the end-fire array has a peak substantially higher than the desired level, e.g., as in FIG. 8. The object of the design procedure is to determine those spacings between elements that will reduce the peak of the first and all other sidelobes below a predetermined level. As the above-referenced patent, the response is differentiated at the peak of the first sidelobe with respect to the distance $D_i$. For the end-fire array, this differentiation results in $$\frac{\delta R}{\delta D_i} = \frac{-2}{2N}\,[4\pi(\sin\theta - 1)]\,\sin\,[4\pi D_i(\sin\theta - 1)] \tag{8}$$

due to the aforementioned 90° shift and the frequency doubling.

The change in the distance $D_i$ by which the element is moved is proportional to the partial derivative of the response R with respect to the distance $D_1$ so that $$\Delta D_i = P\frac{\delta R}{\delta D_i} \tag{9}$$

where P is the constant of proportionality. The change $\Delta R$ in response is $$\Delta R = \sum_{i=1}^{N} \frac{\delta R}{\delta D_i}\,\Delta D_i \tag{10}$$

and the relative change in response is found by dividing each side of equation 9 by R:

$$\frac{\Delta R}{R} = \frac{1}{R}\sum_{i=1}^{N} \frac{\delta R}{\delta D_i}\,\Delta D_i \tag{11}$$

Substituting the value for $\delta R/\delta D_i$ from equation (8) and the value for $\Delta D_i$ from equation (9) into equation (11) and simplifying, the value of the relative change $\Delta R/R$ becomes $$\frac{\Delta R}{R} = \frac{4P}{4RN^2}\,[(4\pi(\sin\theta - 1)]^2 \sum_{i=1}^{N} \sin^2[4\pi D_i(\sin\theta - 1)] \tag{12}$$

The expression to the right of the summation sign in equation (12) contains N terms, each of which has an average value of $\frac{1}{2}$ and can be approximated by N/2. Equation (12) can then be further simplified:

$$\frac{\Delta R}{R} = \frac{P}{2RN}\,[4\pi(\sin\theta - 1)]^2 \tag{13}$$

If K is defined as being equal to $\Delta R/R$ to produce the desired level of sidelobes, equation (13) can be rearranged so that $$P = \frac{KRN}{[4\pi(\sin\theta - 1)]^2} \tag{14}$$

and the distance $\Delta D_i$ can be calculated from equations (8), (9), and (14):

$$\Delta D_i = \frac{KR}{4\pi(\sin\theta - 1)}\,\sin[4\pi D_i(\sin\theta - 1)] \tag{15}$$

After determining $\Delta D_i$ for each of the distance $D_1$, $D_2$, . . . the corresponding positions of the elements are adjusted to be $(D_1 \pm \Delta D_1)$, etc.

The response corresponding to the peak of the second sidelobe is then determined. The relative change in the response desired is the difference between the second sidelobe peak and the desired level of the first sidelobe peak. Equation (15) is used as previously to provide new distances $(D_1 \pm \Delta D_1)$, $(D_2 \pm \Delta D_2)$, . . . by which the element distances must again be varied. Peaks of the third and all remaining sidelobes are then calculated and the corresponding distances $(D_i \pm \Delta D_i)$ are found. After adjusting all these distances, however, it will generally be found that the original length of the array will have been changed. At this length, the design constraint will have been violated. It is therefore necessary to change the length of the array back to the original length so as to correspond with the design frequency. Consequently, the distance of each element must be proportionally changed so that the length of the array will correspond to the desired length. By repeating the process described above several times and normalizing the length of the array each time, the desired response pattern shown in FIG. 12 is obtained.

The tubes 90 are tied together in a bundle so that one end of each tube is coupled to a transducer 92. The other end of each tube is open. When the transducer 92 is a microphone and the microphone structure is pointed in the direction of a source of sound, that sound will be picked-up, the structure discriminating against noise, i.e., discriminating against sounds from sources other than the target source.

Figure 11:
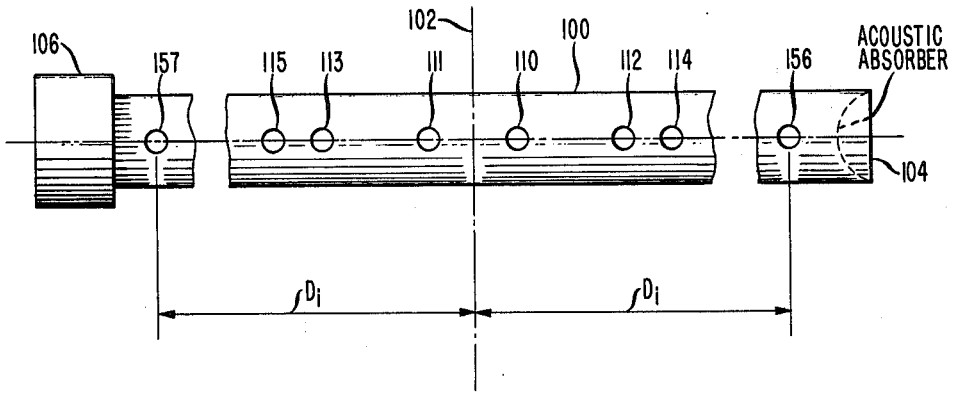
FIG. 11 shows an acoustic endfire array comprising a plurality of apertures spaced nonlinearly apart in a tube in accordance with the present invention.

Referring to FIG. 11, there is shown another embodiment of the coupling path 82 shown in FIG. 9. The coupling path comprises a hollow tube 100, one end of which is capped with an acoustic sound absorbing plug 104 and the other end of which is coupled with a transducer 106. Tube 100 has a plurality of collinear apertures arranged in pairs: 110,111; 112,113; 114,115; . . . so that the apertures of each pair are equidistant from a center line 102 drawn perpendicular to the length of the tube 100. Furthermore, in accordance with the present invention, the distance between the pairs vary according to the method of steepest descent disclosed in detail in U.S. patent application, Ser. No. 104,375, filed Dec. 17, 1979 by the applicant herein and assigned to the assignee herein.

Figure 12:
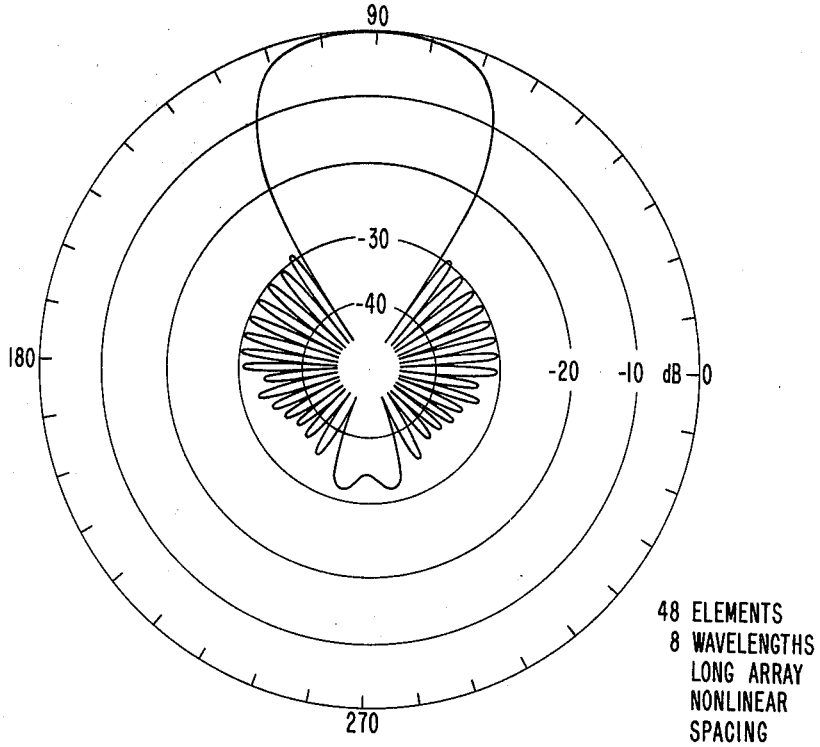
FIG. 12 shows the response pattern for an endfire microphone array or an endfire loudspeaker array using the structures of either FIGS. 10 or 11.

The response from the endfire array in FIG. 11, i.e., steered to an angle of $\pi/2$ radians or 90 degrees, is shown in FIG. 12. There is shown one main lobe 140 at 90 degrees, and a plurality of substantially smaller sidelobes in accordance with the objective for the present invention. Such a response pattern is obtained also for the structure shown in FIG. 10.

The directivity index of an acoustic endfire array as shown in FIGS. 10 or 11 is 3 dB better than a broadside array of FIG. 1 which is steered to 90 degrees. This means that an endfire array 3 feet long is as effective in reducing undesirable noise as of a broadside array 6 feet long.

The table 1 below shows the spacing for a 48 element array, 8 wavelengths long and designed for optimum performance at 3521 Hz.

TABLE 1

| Element Numbers | Distances From Center Line In Wave Lengths | Distances From Center Line In Inches |
|---|---|---|
| 110,111 | 0.0566 | 0.218 |
| 112,113 | 0.1703 | 0.655 |
| 114,115 | 0.2851 | 1.096 |
| 116,117 | 0.4012 | 1.543 |
| 118,119 | 0.5184 | 1.993 |
| 120,121 | 0.6362 | 2.446 |
| 122,123 | 0.7547 | 2.901 |
| 124,125 | 0.8747 | 3.362 |
| 126,127 | 0.9973 | 3.834 |
| 128,129 | 1.1236 | 4.319 |
| 130,131 | 1.2537 | 4.820 |
| 132,133 | 1.3875 | 5.334 |
| 134,135 | 1.5251 | 5.863 |
| 136,137 | 1.6672 | 6.409 |
| 138,139 | 1.8154 | 6.979 |
| 140,141 | 1.9722 | 7.582 |
| 142,143 | 2.1399 | 8.227 |
| 144,145 | 2.3206 | 8.921 |
| 146,147 | 2.5159 | 9.672 |
| 148,149 | 2.7296 | 10.493 |
| 150,151 | 2.9720 | 11.425 |
| 152,153 | 3.2668 | 12.559 |
| 154,155 | 3.6390 | 13.989 |
| 156,157 | 4.0000 | 15.377 |

Whereas the spacings between elements have been determined based on the far field i.e., the acoustic radiation field at large distances from the source, response criteria, the structures in FIGS. 10 and 11 can be used equally well under the near field i.e., the acoustic radiation field close to the source, conditions without changing the spacings. As discussed in U.S. Pat. No. 4,311,874, far field design criteria refer to acoustic waves from several sound sources that are assumed to arrive as a plane and to impinge each element equally.

Referring again to the endfire array 100 of FIG. 11, when transducer 106 is a loudspeaker, the signal radiated therefrom will weaken progressively as it advances through tube 100 because of radiation through the apertures 115 . . . 157, 113, 111 . . . 156. The larger the apertures, the greater the radiation will be. The radiation measured at each aperture is the pressure or excitation thereat.

Figure 13:
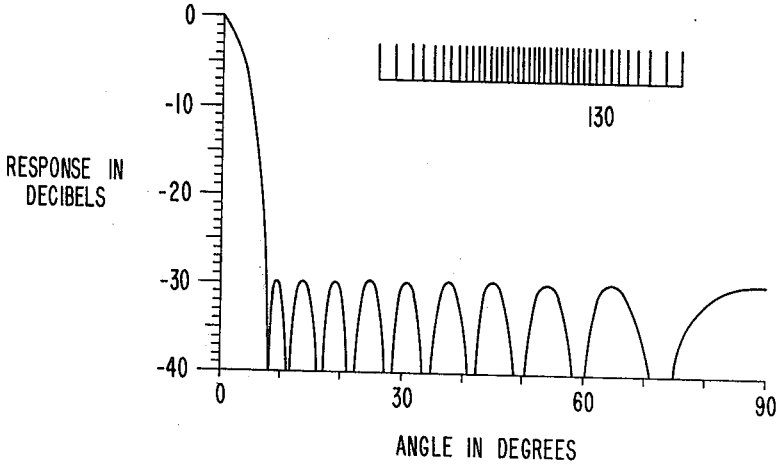
FIGS. 13, 14 and 15 show response patterns for endfire arrays of FIG. 11 by varying the aperture size.

When the apertures are relatively small, the excitation at each aperture will be substantially the same, shown by the indicium 130 in FIG. 13. Also shown in FIG. 13 is the desired response for the endfire array of FIG. 11. It is to be noted as stated hereinabove, all the apertures in FIG. 11 have the same size.

Figure 14:
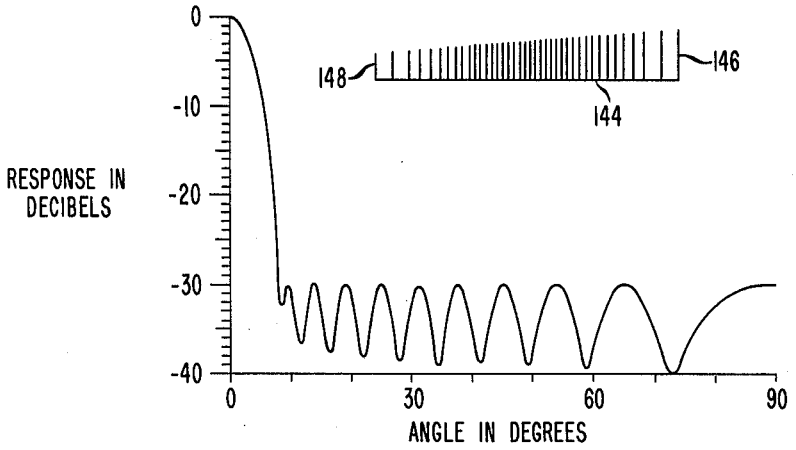

As the aperture of FIG. 11 are uniformly increased in size, the excitation at the aperture nearest the loudspeaker 106, i.e., aperture 157, will be larger than the excitation at the aperture farthest from the loudspeaker 106, i.e., aperture 156. Shown in FIG. 14 are the response for one embodiment of the endfire array in FIG. 11 and the excitation 144. The excitation 146 at aperture 157 is twice as large as the excitation 148 at aperture 156. The envelope of the sidelobes in the response, is as low as that in FIG. 13. Furthermore, there has been no degradation in the directional response pattern except for a small widening of the main lobe.

Figure 15:
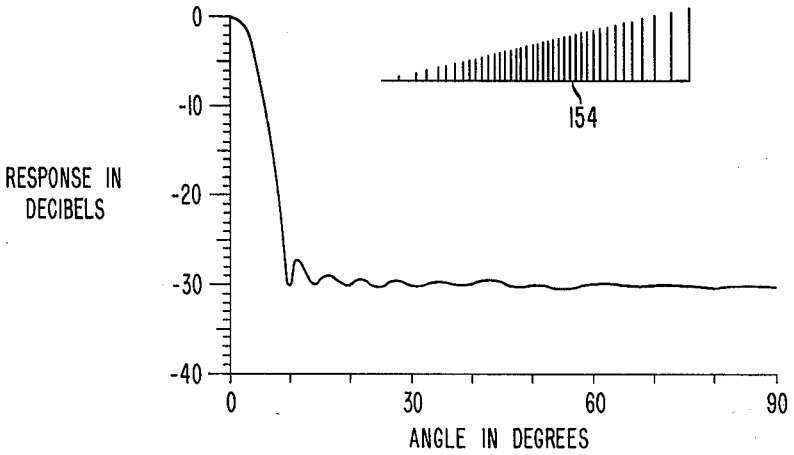

When the apertures of FIG. 11 have been made so large, that there is no excitation at aperture 156, farthest from the loudspeaker 106, the excitation pattern will appear as shown by indicium 154 in FIG. 15. Again, the envelope of the sidelobes in the response will be as low as that in FIGS. 13 and 14 and there will be no degradation in the directional response pattern except for a small widening of the main lobe.

Thus, the variation in excitation at the aperture by increasing the size thereof does not result in any degradation of the response pattern provided the excitation decreases linearly from one end of the tube to the other. The relationship of the spacing between the apertures, however, are nonuniform, or nonlinear, as defined hereinabove. A substantial amount of the sound generated by the loudspeaker 106 in FIG. 11 is thus radiated through the apertures without degrading the response pattern of the loudspeaker.

What is claimed is:

1. Acoustic end-fire apparatus for producing a directional response comprising a sound transducer; and a plurality of acoustical paths coupling the sound transducer to the atmosphere, each path having a transducer end and an atmosphere end; and a centerline corresponding to a line equidistant from the atmosphere end of the shortest path and the atmosphere end of the longest path;

the acoustical paths being arranged in an array of pairs, the atmosphere ends of the ith pair being equal distances $D_i$ on opposite sides of said centerline; the distance between any path atmospheric end and the centerline being given by the application of the recursive formulae:

$$D'_i = D_i - \Delta D_i$$

$$\Delta D_i = \frac{KR}{4\pi\,(\mathrm{Sin}\theta - 1)} \sin[4\pi\, D_i\,(\sin\theta - 1)]$$

where R is the response of the apparatus given by the formula $$R = \frac{2\sum_{i=1}^{N} \mathrm{Cos}[4\pi\, D_i\,(\mathrm{Sin}\theta - 1)]}{2N}$$

$K = \Delta R/R$, the desired fractional change in response, $\Delta R$ = desired change in response, $2N$ = number of paths, $D_i$ = initial distance of the ith path atmospheric end from the centerline of the array, $D'_i$=final distance of the ith path atmospheric end from the centerline array, $\theta$=angle of incidence which a sound wavefront makes with the centerline.

2. The apparatus according to claim 1 wherein said paths are tubes and wherein said tubes have substantially the same diameters.

3. The apparatus according to claim 1 wherein said sound transducer is a loudspeaker coupled at one end of said tubes.

4. The apparatus according to claim 1 wherein said sound transducer is a microphone coupled as said one end of said tubes.

5. The apparatus according to claim 1 wherein said apertures have substantially the same size.

6. The apparatus according to claim 1 wherein said sound transducer is a loudspeaker.

7. The apparatus according to claim 1 wherein said sound transducer is a microphone.

8. An acoustic structure comprising a tube (100) having a plurality of elements arranged in pairs (110, 111; 112,113; ... 156,157) whereby the elements in each of said pairs are at equal distances from and on opposite sides of a center line (102) and said element pair distances in wavelengths are defined as

±0.0566, ±0.1703, ±0.2851, ±0.4012, ±0.5184, ±0.6362, ±0.7547, ±0.8747, ±0.9973, ±1.1236, ±1.2537, ±1.3875, ±1.5251, ±1.6672, ±1.8154, ±1.972, ±2.1399, ±2.3206, ±2.5159, ±2.7296, ±2.9720, ±3.2668, ±3.6390, and ±4.0000.

9. Acoustic end-fire apparatus for producing a directional response comprising a sound transducer;

a tube having first and second ends and a centerline equidistant from said first and second ends;

said sound transducer being coupled to said first end and an acoustic absorber attached to said second end; and a plurality of acoustic paths along said tube, each path terminating at said first end and at an aperture between said first and second ends; said apertures being arranged in pairs about said centerline, the ith pair of apertures being equidistant a distance $D_i$ on opposite sides of said tube centerline; the distance between apertures of the ith pair and the centerline being given by the application of the recursive formulae:

$$D'_i = D_i - \Delta D_i$$

$$\Delta D_i = \frac{KR}{[4\pi(\mathrm{Sin}\theta - 1)]} \sin[4\pi D_i(\sin\theta - 1)]$$

where R is the response of the apparatus according to the formula $$R = \frac{2\sum_{i=1}^{N} \mathrm{Cos}[4\pi D_i(\mathrm{Sin}\theta - 1)]}{2N}$$

K=ΔR/R, the desired fractional change in response,

ΔR=desired change in response,

2N=number of paths, $D_i$=initial distance of the ith path atmospheric end from the centerline of the array, $D'_i$=final distance of the ith path atmospheric end from the centerline of the array, $\theta$=angle of incidence which a sound wavefront makes with the centerline.

* * * * *

UNITED STATES PATENT AND TRADEMARK OFFICE

CERTIFICATE OF CORRECTION

PATENT NO. : 4,421,957

DATED : December 20, 1983

INVENTOR(S) : Robert L. Wallace, Jr.

It is certified that error appears in the above—identified patent and that said Letters Patent is hereby corrected as shown below:

Column 5, line 49, "$D_1$" should read --$D_i$--.

Column 7, line 33, "3.362" should read --3.363--.

Column 8, line 4, "aperture" should read --apertures--.

Signed and Sealed this

*Fourth* Day of *December 1984*

[SEAL]

*Attest:*

GERALD J. MOSSINGHOFF

*Attesting Officer*

*Commissioner of Patents and Trademarks*